US011804664B2

(12) United States Patent
Martens

(10) Patent No.: US 11,804,664 B2
(45) Date of Patent: Oct. 31, 2023

(54) CABLE CONNECTOR FOR MOTOR VEHICLES

(71) Applicant: Auto-Kabel Management GmbH, Hausen (DE)

(72) Inventor: Sebastian Martens, Straelen (DE)

(73) Assignee: Auto-Kabel Management GmbH, Hausen i. W. (DE)

( * ) Notice: Subject to any disclaimer, the term of this patent is extended or adjusted under 35 U.S.C. 154(b) by 0 days.

(21) Appl. No.: 18/044,864

(22) PCT Filed: Aug. 16, 2021

(86) PCT No.: PCT/EP2021/072723
§ 371 (c)(1),
(2) Date: Mar. 10, 2023

(87) PCT Pub. No.: WO2022/053264
PCT Pub. Date: Mar. 17, 2022

(65) Prior Publication Data

US 2023/0291135 A1 Sep. 14, 2023

(30) Foreign Application Priority Data

Sep. 10, 2020 (DE) ..... 10 2020 123 612.3

(51) Int. Cl.
*H01R 25/00* (2006.01)
*H01R 11/11* (2006.01)
(Continued)

(52) U.S. Cl.
CPC ..... *H01R 11/11* (2013.01); *H01R 13/20* (2013.01); *H01R 13/28* (2013.01); *H01R 13/639* (2013.01); *H01R 2201/26* (2013.01)

(58) Field of Classification Search
CPC ..... H01R 11/11; H01R 13/28; H01R 13/20
See application file for complete search history.

(56) References Cited

U.S. PATENT DOCUMENTS 1,003,973 A * 9/1911 Schutz ..... E04B 1/2604 81/177.85
1,975,244 A * 10/1934 Wiseman ..... F16B 7/22 403/339
(Continued)

FOREIGN PATENT DOCUMENTS

DE 27 05 798 A1 8/1978
DE 10 2007 018 175 A1 11/2007
(Continued)

OTHER PUBLICATIONS

International Searching Authority/EP, Application No. PCT/EP2021/072723, dated Nov. 23, 2021, 17 pages.
(Continued)

*Primary Examiner* — Neil Abrams
(74) *Attorney, Agent, or Firm* — Sunstein LLP

(57) ABSTRACT

A high-current cable connector comprises two metal parts and a interlocking member. The interlocking member moves the metal parts outward so that two abutting surfaces per metal part are pressed together. The alignment of the abutting surfaces causes two other surfaces per metal part, the contact surfaces, to also be pressed together and the cable connector is locked. This results in an easy-to-assemble cable connector with low contact resistance and high thermal capacity.

22 Claims, 12 Drawing Sheets

(51) Int. Cl.
*H01R 13/20* (2006.01)
*H01R 13/639* (2006.01)
*H01R 13/28* (2006.01)

(56) References Cited

U.S. PATENT DOCUMENTS 2,490,316 A 12/1949 Ostrak
2,591,437 A * 4/1952 Haugsrud ..... H01R 13/20 439/294
3,220,757 A * 11/1965 Potter ..... F16D 1/108 403/340
4,146,288 A * 3/1979 Ramsay ..... H01R 13/625 439/316
4,626,126 A * 12/1986 Suchdev ..... H01R 4/58 72/364
4,634,202 A * 1/1987 Taylor ..... G02B 6/3847 439/294
4,695,110 A 9/1987 Wasserlein
4,702,539 A * 10/1987 Cusick, III ..... H01R 13/213 439/588
4,806,042 A * 2/1989 Swank ..... F16B 3/00 403/101
4,995,824 A * 2/1991 Falco ..... H01R 11/11 439/286
5,098,216 A * 3/1992 Caperton ..... F16D 1/02 403/393
5,118,303 A * 6/1992 LeBaron ..... H01R 24/84 439/744
5,174,777 A 12/1992 Carter
6,855,012 B2 * 2/2005 An ..... H01R 11/12 439/864
8,079,863 B2 * 12/2011 Wason ..... H01R 11/12 439/877
8,480,423 B2 * 7/2013 O'Sullivan ..... H01R 11/03 439/287
9,203,181 B2 * 12/2015 Schumacher ..... F03D 80/85
10,490,926 B2 * 11/2019 Castonguay ..... H01R 43/26
2021/0293265 A1 * 9/2021 Giemza ..... F16G 11/10

FOREIGN PATENT DOCUMENTS

DE 10 2011 018 353 A1 10/2012
DE 10 2012 010 277 A1 11/2013
EP 3 340 390 A1 6/2018
FR 2 580 344 A1 10/1986
GB 2578832 A 5/2020

OTHER PUBLICATIONS

German Patent Office, Office Action, Application No. 10 2020 123 612.3, dated Aug. 4, 2021, 10 pages (in German).

* cited by examiner

CABLE CONNECTOR FOR MOTOR VEHICLES

CROSS-REFERENCE TO RELATED APPLICATIONS

This application is the national phase entry of international patent application no. PCT/EP2021/072723, filed Aug. 16, 2021 and claims the benefit of German patent application No. 10 2020 123 612.3, filed Sep. 10, 2020, the disclosures of which are incorporated herein by reference in their entirety.

TECHNICAL FIELD

The subject matter relates to a cable connector for motor vehicles and a method of manufacturing a cable connector.

BACKGROUND ART

In the course of the increasing electrification of automobility, higher and higher currents are transmitted in vehicles. This is usually done via electrical cables. To enable connections between a component such as power electronics, a battery, a motor, etc. and cables as well as connections between a first cable and a second cable, cable connectors are further used.

So-called plug connectors are widely used. Well-known connectors in the automotive sector are mostly based on spring contacts. In such spring-loaded connectors, a first and a second current-carrying base body, usually made of metal, are connected/clamped together with a spring arranged between them. The spring's restoring force enables permanent mechanical and electrical contact between the spring element and the two basic bodies. These springs, which are often very thin, are designed in such a way that they have many punctiform projections at least on a contact surface adjacent to a base body, at which the mechanical and electrical connection is established. The electrical current flows between the spring and the base body at the contact points. Due to the limited area of such a reliefed surface, the contact resistance increases and Joule heating of the transition occurs. An increase in current-carrying capacity or a reduction in contact resistance and thus also in power dissipation is achieved in such a design almost exclusively by increasing the number of contact points. The choice of spring material for spring connectors is always a compromise between electrical conductivity and mechanical properties such as Young's modulus or relaxation.

In addition to conducting electrical energy, the cables of today's vehicles also increasingly serve to conduct heat, not least because of the good thermal conductivity of their electrical conductor materials such as copper and aluminum. As a result, cables are now often an essential component of thermal management in vehicles. A coupling between two cables or between cables and electrical components, as well as between electrical components themselves, e.g. between battery cell connectors or battery module connectors themselves or with a battery cell, a so-called flying lead, therefore also has the task of conducting heat in addition to conducting electricity. However, connectors are poorly suited for this purpose, because such transitions in the cable harness often generate additional unwanted heat due to Joules losses. In addition, heat transfer is impeded by the often thin spring components. Worse still, the low heat capacity of the design-related thin springs can lead to rapid heating, which in the worst case can cause cable fires.

Screw connectors are far more suitable for heat transfer. Here, comparatively large surfaces of two basic bodies are pressed together with a force generated by a thread. The large-area contact reduces the ohmic resistance and increases the thermal conductivity. Screw connectors also usually have a large thermal mass compared with plug connectors. They therefore heat up more slowly at high instantaneous currents than thin springs. In this way, they ensure a low risk of overheating with a sluggish thermal behavior of the connection. Such a large thermal mass and high thermal conductivity is particularly necessary in the power train of electric-powered vehicles, where high currents can occur during braking (via recuperation), acceleration or high-current charging.

However, the disadvantage of a screw connection is that, compared to a plug-in connection, a screw connection is a more complex assembly step that takes longer and is more prone to errors. This is particularly problematic in view of the increasingly automated production in the field of electromobility. The increased time required to assemble screw connections makes them unattractive for automated manufacturing. For example, in the production of high-current batteries, where a large number of battery cells and battery modules have to be contacted with each other, the large number of screw connections means a considerable assembly effort. In addition, screw connectors can cause problems due to defective threads or similar, which is why contact parts with two screw elements next to each other are already used in some screw connectors in order to reduce the susceptibility to faults/error rates. This leads to further assembly effort.

The subject matter was thus based on the object of combining the advantages of a screw connection with those of a plug connection. To this end, large surfaces are to be pressed onto each other with high normal forces to produce good electrical and thermal conductivity. Furthermore, the connector should have a large heat capacity in order to be able to absorb a lot of thermal energy and not heat up quickly. Another focus is on assembly, which should be fast, reproducible and as easy to automate as possible.

SUMMARY OF THE INVENTION

The connector according to the subject matter comprises a first metal part and a second metal part. In particular, the metal parts may comprise copper or a copper alloy and/or aluminum or an aluminum alloy. For example, high strength aluminum alloys such as EN AW 6082 may be used. Other materials such as other metals or alloys thereof, such as steel, silver, gold, lead, etc. can also be used, or other conductors such as polymers, semiconductors, or the like. Combinations of non-conductors and conductors can also be used, in which conductors are arranged at least on contact surfaces to be described later, and the non-conductors perform purely mechanical functions. Combinations of different, better and worse conducting, materials, such as different metals, for example copper and steel, can also be combined. In this way, good conductivity on the one hand and high mechanical stability on the other can be achieved at reduced cost compared to a single-metal finish.

The two metal parts can be made of the same material, in particular the same metal material. This has the advantage that contact corrosion due to different redox potentials of different metals is excluded. Another advantage is that there are no different thermal expansion coefficients. Thus, the two metal parts expand equally when heated and thermal stresses are avoided.

It is also possible that both metal parts are made of different materials and/or combinations of materials, in particular two different metal materials. For example, a first metal part can be made of copper or a copper alloy and a second metal part can be made of aluminum or an aluminum alloy. Thus, aluminum cables, for example solid flat conductors, and copper conductors, for example flexible stranded conductors, can each be connected to a metal part of the cable connector in a single type. In this way, contact corrosion between the cable and the connector is reduced or prevented.

At least one of the metal parts can be made of solid material. This is advantageous for the heat capacity of the component. It is also possible that at least one of the metal parts comprises segments of flat parts. In this way, on the one hand, high stability can be achieved with low weight and low material usage. On the other hand, the increased surface area may favor radiation of heat and thus allow a higher maximum dissipation of the cable connector. In any case, the size of the metal parts can be adapted to the cable thickness and/or current strength and thus to expected heat generation and power loss. A higher size leads to a higher surface area over which heat can be radiated and transported away by convection. In addition, a higher volume leads to a higher heat capacity.

Connection terminals for conductors can be provided on one or both metal parts. These can be round, flat or otherwise shaped connection lugs. The terminal lugs may be formed for soldering or welding, e.g., friction welding, ultrasonic welding, resistance welding, laser welding, etc., of cables. The terminal lugs may be roughened, coated, or otherwise surface treated. Also, one or more holes may be provided in the terminal lugs. The connection terminals can also be formed as sleeves and/or cable lugs. They may be suitable for contacting and/or accommodating flat conductors, round conductors, solid conductors and/or stranded conductors. The connection terminals are preferably made of the same material as the metal part to which they are attached. They may also be made of a different material.

In order to define the relationships of surfaces to each other in the following, surface normals are used. First, a surface is a contiguous area on a three-dimensional body that can be divided into several segments. A surface need not be flat, but can be composed of segments of different spatial orientations. The orientation of a surface segment is characterized by its surface normal. A surface normal is a vector that is exactly perpendicular to the associated surface segment. In the following, surface normals of a surface segment of a body are oriented away from the body so that the vector lies outside the body. The length of the surface normal vector is irrelevant and is defined as normalized to a value, for example, the value 1 of a certain chosen unit of length. Two vectors are described below as being opposite to each other if their scalar product is less than zero. It is possible but not necessary that the two vectors are exactly antiparallel to each other. If the two vectors are perpendicular to each other, their scalar product is exactly zero.

The two metal parts abut each other in areas. A interlocking member is provided which moves the two metal parts apart. The interlocking member moves each metal part in a respective locking direction. The respective locking direction can be represented by a vector. The locking directions of the two metal parts are opposite to each other (see above, scalar product less than zero) and may in particular be substantially antiparallel to each other.

The interlocking member may be formed as one locking surface on each of the two metal parts, which are opposed to each other and which are spaced from each other by a gap. By inserting a third element, a interlocking member, between the two locking surfaces, the two metal parts can be moved apart. The interlocking member can here be shaped as a cuboid, cylinder, or otherwise, in particular the interlocking member can be tapered along a spatial axis. The interlocking member can thus be shaped as a wedge. The interlocking member is preferably inserted into the gap in an insertion direction that is oriented differently from the locking directions of the two metal parts. The insertion direction may be oriented substantially perpendicular to the locking direction of at least one of the two metal parts. The interlocking member may be roughened for better grip, for example by means of knobs, grooves, a corrugation, a rough coating etc. Also, at least one of the locking surfaces may be shaped accordingly. It is also possible that the interlocking member and/or at least one of the locking surfaces is coated, for example with non-conductors such as silicone, rubber, plastic, which in particular can deform elastically and thus absorb mechanical stresses. Also, the interlocking member and/or at least one of the locking surfaces may be coated with a conductive coating such as nickel, tin, etc., which may be softer than the other material of the interlocking member.

The interlocking member may be made at least in part of a similar or the same material as one or both of the metal members. This choice of material avoids different thermal expansion coefficients and prevents contact corrosion. It is also possible for the interlocking member to be formed of a different material than at least one of the metal members, which may be either conductive or non-conductive. The interlocking member may be formed from a solid material. In this case, it may be formed from a low compressibility material such as solid copper or aluminum. It is also possible for the interlocking member to be formed of a resilient material such as plastic, rubber, silicone, etc., or combinations of materials such as rubberized glass or ceramic. In this case, a interlocking member made of a solid material can, at least in sections, fit exactly into the gap between the two locking surfaces, the width of which is determined by the other design of the connector as described below.

It is also possible that the interlocking member is not formed from a solid material, but has an elastic structure with resilient characteristics. For example, it may comprise metal stirrups. The elastic elements, for example stirrups, can absorb mechanical stresses as deformation and fit flexibly into the gap between the locking surfaces. No further material need be arranged between the elastic elements. However, it is also possible for the interlocking member to comprise other components in addition to the elastic elements, such as a supporting, electrically conductive or non-conductive filling, which can be solid or elastic, etc.

The interlocking member may be formed as a separate element, completely separable from the two metal parts. It may also be attached to one of the two metal parts in a guided manner. For example, a rail may slidably support the locking member in substantially one direction. It is also possible to arrange the interlocking member rotatably on one of the metal parts and to screw it in for locking. Since the contact with a turned-in interlocking member can be small in relation to a pushed-in interlocking member, it is particularly advisable here to roughen the surface, for example by grooving. The advantage of a guided interlocking member is firstly that it cannot be lost if the connection is opened again. In addition, it can be advantageous in assembly if separate interlocking members do not have to be kept in stock.

The metal parts are in contact with each other in certain areas. Contact surfaces are first provided for this purpose. Each of the two metal parts has a front contact surface which lies behind the interlocking member in the locking direction of the metal. Each of the two metal parts also has a second, rear contact surface that lies in front of the interlocking member in the locking direction. Thus, the interlocking member or components of the interlocking member disposed on the respective metal part lies between the two contact surfaces, rear and front, of the metal part. The rear contact surface is spaced from the interlocking member against the respective locking direction of the metal part, and the front contact surface is spaced from the interlocking member with the respective locking direction of the metal part. By interlocking member in this case is meant the part of the interlocking member that is part of the respective metal part. For example, this may be the locking surface on the respective metal part described above.

In addition to the two contact surfaces, the front and the rear, each of the two metal parts also has two further surfaces, the abutment surfaces. A first, front abutting surface is spaced from the interlocking member in the locking direction of the respective metal part. A second, rear abutment surface, is spaced from the interlocking member against the locking direction of the respective metal part. The front abutment surface of each metal part is thus on the same side of the interlocking member along the locking direction as the front contact surface. The rear contact surface and the rear abutment surface of the same metal part are arranged on the respective other side of the interlocking member. The front abutment surface can be located further away from the interlocking member in the locking direction than the front contact surface. The front abutment surface can also lie closer to the interlocking member than the front contact surface, at least in certain areas. The same applies to the rear contact and abutment surfaces.

The front (rear) contact surface and the front (rear) abutment surface of at least one metal member may merge directly into each other, so that an uninterrupted line may be drawn from the abutment surface into the contact surface. Also, the front (rear) contact and abutting surfaces may be separate from each other.

The two metal parts may be shaped substantially identically to each other.

A joined state of the two metal parts can now be defined. Here, the front contact surface of the first metal part abuts the rear contact surface of the second metal part at least in some areas, and the rear contact surface of the first metal part abuts the front contact surface of the second metal part at least in some areas. Also, the front abutment surface of the first metal part abuts the rear abutment surface of the second metal part at least in some areas, and the rear abutment surface of the first metal part abuts the front abutment surface of the second metal part at least in some areas. In this context, abutment means that the surfaces can indirectly or directly exert a force on each other. Preferably, a mechanical and an electrical contact is established between the contact surfaces and/or between the end faces by the abutment. Another element may also be arranged between the surfaces, for example a conductor or a non-conductor. In the case of the abutting surfaces, such an intermediate layer can, for example, absorb mechanical stress and/or promote sliding of the metal parts against each other. In the case of the contact surfaces, such an intermediate layer may be, for example, a conductive, soft foil that compensates for unevenness and establishes good contact. Also, the exemplarily mentioned intermediate elements can be used on the respective other surfaces (abutting or contact surfaces).

In any case, large-area contacting of the surfaces, in particular the contact surfaces of the two metal parts, is advantageous in order to achieve low ohmic resistance and good thermal conductivity.

In the joined state, the two metal parts may have a substantially closed outer surface, which may, for example, substantially describe a cuboid, a cylinder, a sphere, an ellipsoid, a wedge or the like. The snug fit of the two metal parts avoids unnecessary edges so that the risk of damage to adjacent cables or other components, particularly in tight harnesses, is reduced.

In the joined state, the abutting surfaces of each metal part serve one purpose, namely to stop the movement of the respective other metal part in its locking direction. Thus, when the first metal part moves in its locking direction, at least one of its two abutment surfaces, preferably both abutment surfaces, the rear and the front, abuts the abutment surfaces of the second metal part, the front and/or the rear. For this purpose, the abutting surfaces of each of the two metal parts are directed, at least in certain areas, in the opposite direction to the locking direction of the respective other metal part. Here, reference is made to the above definition of "oppositely directed", which states that the scalar product between the surface normals of the abutting surfaces of one metal part is negative to the vector of the locking direction of the respective other metal part. "At least in some areas" is to be understood as meaning that at least part of the surface has an orientation corresponding to this. Since the surface need not consist of a single planar segment, it is conceivable that some portions of the abutting surfaces may not oppose the interlocking direction of the respective other metal part, while others do. In particular, the areas of the abutting surface should be opposed to the locking direction of the respective other metal part, against which the respective other metal part also actually abuts in the joined and/or locked state.

For each pair of abutting abutment surfaces, e.g. the rear of one metal part and the front of the other metal part, only one of the two abutment surfaces can be directed against the direction of movement of the other metal part. The respective other abutment surface can also be formed as a linear or point-shaped or otherwise shaped local elevation. Multiple elevations are also conceivable. Also, the two abutting surfaces of a pair may be aligned flat and substantially parallel to each other in the locked state.

As a further, second purpose, the abutment surfaces redirect the force emanating from the interlocking member at least partially in the direction of the contact surface. For this purpose, the respective front contact surface and the respective front abutment surface of a metal part are first defined as each "belonging" to the other surface, and the respective rear contact surface and rear abutment surface of one and the same metal part are defined as "belonging" to each other. The redirection of the force is now realized by the fact that each abutment surface is not only directed against the locking direction in certain areas, but also against areas of the respective associated contact surface. Consequently, the contact surface is also directed in areas opposite to the associated impact surface.

The interlocking member thus exerts a force on the contact surfaces via the abutting surfaces and presses them against each other with a normal force. The front contact surface of the first metal part is thus pressed against the rear contact surface of the second metal part. The rear contact surface of the first metal part is also pressed against the front contact surface of the second metal part. A large force is advantageous to ensure a good contact with low contact resistance. As described above, it is advantageous if both metal parts and the interlocking member have similar to the same expansion coefficients so that the normal force does not decrease in an expected temperature range of −40° C. to 150-180° C. due to different expansion coefficients.

As described above, the surfaces, i.e., both contact surfaces and impact surfaces, need not be completely flat and formed from a single flat segment, but may be formed from multiple differently oriented segments. In particular, the contact and/or abutting surfaces may be provided with a relief. This may be shaped as ridges and grooves along which one metal part can slide along the other. For example, these relief structures may be substantially constant along the respective locking direction, in particular if the locking direction of a metal part is exactly perpendicular to the surface normal of a relief contact surface. It is also possible for the contact and/or abutting surfaces to be concave and/or convex in shape. In an advantageous embodiment, the relief structures of the two metal parts engage in one another so that, on the one hand, the size of the contact surface is increased compared to flat surfaces and, on the other hand, guidance of the metal parts against one another is realized. In particular, for example, the respective front contact surface can have concave recesses and the respective rear contact surface can engage in these concave recesses with a convex formation. Also, the respective front contact surface can have convex recesses and the respective rear contact surface can engage in these convex recesses with a concave formation. The same can apply to front and rear abutting surfaces. Of course, other surface textures are conceivable, such as serrated, triangular, toothed reliefs, etc.

In a preferred embodiment, the contact surfaces of a first metal part are aligned parallel to the locking direction of the respective metal part and/or the other metal part, at least in certain areas. The same may apply to the second metal part. The metal parts can then slide along each other at the contact surfaces.

Also, the contact surfaces of one metal part, rear and front, can be aligned substantially parallel to each other, at least in areas, but also in their entirety. Also, the two contact surfaces of both metal parts can all four be aligned parallel to each other at least in areas, but also in their entirety. The same can apply to the abutting surfaces, both for one metal part but also for both metal parts equally.

Also, the contact surfaces of a pair of abutting contact surfaces, formed by one contact surface of each of the two metal parts, can be substantially parallel to each other. This may apply to both pairs of contact surfaces of the cable connector. The same may apply to the abutting surfaces.

In a preferred embodiment, both the locking directions of both metal parts and the surface normals of both contact surfaces and both abutting surfaces of both metal parts each run, at least in some areas, substantially parallel to a common plane or to each other.

The abutting surfaces and/or contact surfaces can be coated at least in some areas. In particular, they may be provided with a nickel and/or tin coating, which may be softer than the main material of the metal parts and thus provide better contact. The abutting surfaces and/or contact surfaces can also be surface-treated in some other way, for example polished and made particularly flat.

Other designs are conceivable as an alternative to the interlocking member comprising locking surfaces and a retractable interlocking member. For example, a screw mechanism is conceivable which is anchored in a thread in one of the two metal parts and can be approached from this against the other metal part to a locking surface. Also, both metal parts can have such screw elements that can be extended against each other. Snap elements or spring elements firmly attached to the metal part are conceivable, which are clamped into one another when the two metal parts are hooked together, thus permanently exerting a force and maintaining contact between the metal parts in the joined state.

To protect against moisture and other environmental influences, a protective sheathing can be provided for the cable connector. This may comprise a coating on the metal parts, for example of plastic, silicone, ceramic, rubber, glass, etc. This coating is preferably applied to the surfaces of the metal parts which are not contact and/or impact surfaces. The coating may also be arranged in the area of the interlocking member, but the surface of the metal parts in this area may also be excluded therefrom. The coating may, in order to achieve a good seal of the cable connector in the joined state, project laterally beyond the contact and abutting surfaces, so that in the joined state no gap remains through which water and other chemicals can penetrate. Also, the protruding coating edges may be arranged as a groove on one metal part and a lip on the other metal part so that they interlock when the metal parts are joined. Also, the edges of the coatings of both metal parts may be shaped the same, such as lips, thickenings, grooves, etc. It may be advantageous to select the coating of one metal part to be harder than the coating of the other metal part, so that the coating edge of the first metal part can press into the coating of the other metal part and thus achieve a better sealing effect.

It may happen that the interlocking member leaves an opening in the cable connector, for example if a interlocking member is countersunk between the locking surfaces. In order to nevertheless achieve insulation against moisture and other environmental influences, a cover may be provided to cover the remaining opening. Also, the interlocking member itself may close the opening spanned by the two metal elements. For this purpose, the wedge may have, for example, an insulating cap. A closure of the opening can in particular create a protection against contact, in particular against fingers (standard IPxxB) or wires (standard IPxxD), and/or seal the opening watertight and/or airtight and/or hermetically.

Also possible is a housing around the entire cable connector, which is placed around it in the joined state. The housing can be made of silicone, rubber, preferably harder materials such as plastic, or even ceramic. Also, two or more housing parts may be separately placed around and/or attached to both metal parts, and these may also be sealingly joined together in the joined state. Snap elements and/or a circumferential seal made of a softer material than the housing, for example silicone or rubber, can permanently ensure the sealing effect.

In a further embodiment, a metal part may have, in addition to the first two contact surfaces, abutting surfaces and parts of a first interlocking member, further two contact surfaces, further two abutting surfaces and parts of a further interlocking member. The metal part so formed may be connected to one, two or more further metal parts to provide, for example, a Y-connection. Also, a metal part may have further connecting surfaces and interlocking members and enable a 4, 5 and 6 coupling or a connection of more elements and/or cables.

In particular, the metal parts can be manufactured by, for example, die casting, investment casting or an extrusion process. These processes allow a particularly fine, flat and uniform surface. However, it is also possible to choose other processes, which may be combined with a downstream surface treatment.

BRIEF DESCRIPTION OF THE DRAWINGS

The subject matter is explained in more detail below by means of drawings showing embodiments. The drawings show.

DETAILED DESCRIPTION OF SPECIFIC EMBODIMENTS

Figure 1A:
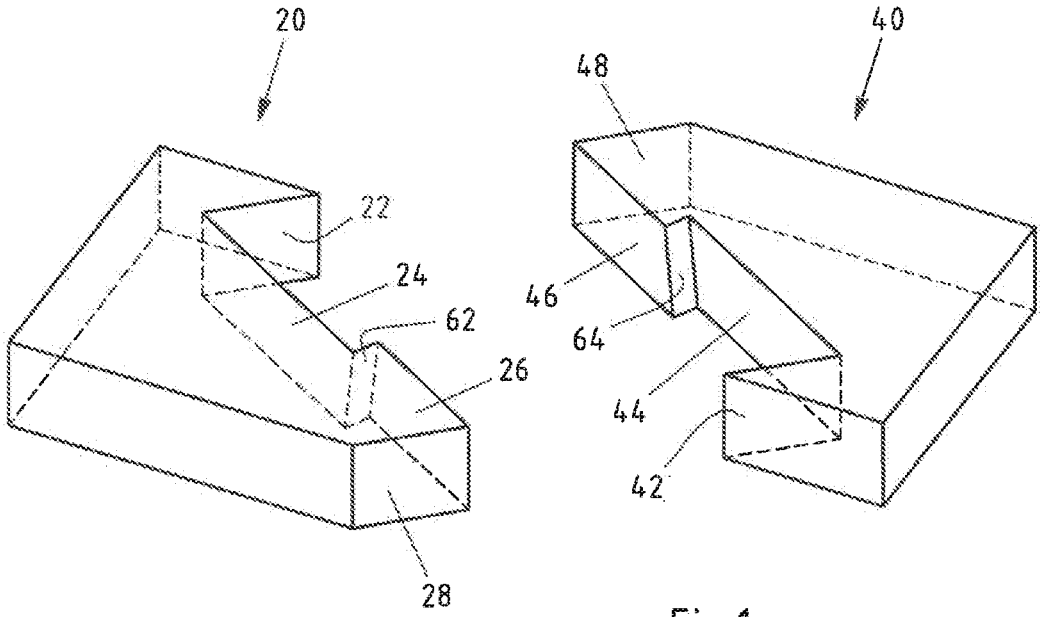
FIG. 1*a-b* Embodiments of the two metal parts of the present cable connector.

The present cable connector 1 is formed of a first metal part 20 and a second metal part 40, which are shown in FIG. 1*a*. The first metal part 20 has a front abutting surface 28, a rear abutting surface 22, a front contact surface 26 and a rear contact surface 24. Analogously, a second metal part 40 is provided. This in turn has a front abutment surface 48, a rear abutment surface 42, a front contact surface 46 and a rear contact surface 44.

It may be advantageous to match the two metal parts 20, 40 in their outer dimensions, in particular their thickness, so that few edges protrude after joining. In particular, it is possible for the two metal parts to be substantially identically shaped.

Figure 1B:
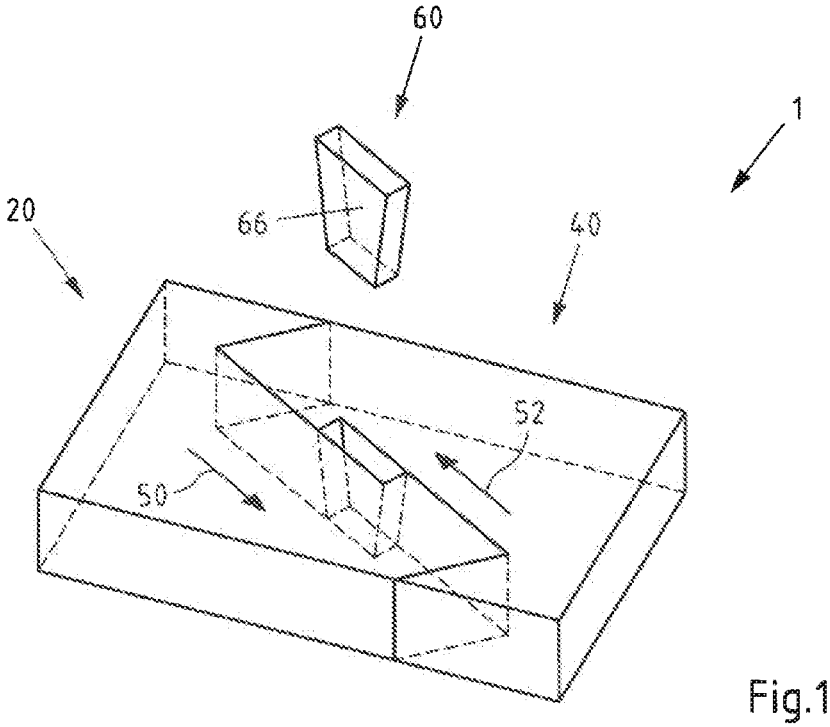

FIG. 1*b* shows the two metal parts 20, 40 in the joined state. Here, the front abutting surface 28 of the first metal part 20 abuts the rear abutting surface 42 of the second metal part 40, and the rear abutting surface 22 of the first metal part 20 abuts the front abutting surface 48 of the second metal part 40. Also, the rear contact surface 24 of the first metal part 20 abuts the front contact surface 46 of the second metal part 40 and the front contact surface 26 of the first metal part 20 abuts the rear contact surface 44 of the second metal part 40, resulting in substantially a cuboid.

The fact that the surfaces abut one another can be understood to mean that they exert a force on one another, at least in certain areas. They may also bear against each other indirectly via one or more further elements arranged between the contacting surfaces.

The two metal parts 20, 40 are displaced relative to each other via a interlocking member 60. In the embodiment shown, a wedge is used here as locking member 66, which is pushed in between two locking surfaces 62, 64. A first locking surface 62 is located on the first metal part 20 and a second locking surface 64 is located on the second metal part 40. By pushing in the interlocking member 66, the latter comes into contact with both locking surfaces 62 and 64 and pushes them, and thus the metal parts 20, 40, apart. Preferably, the interlocking member 66 can be inserted into the gap with an accurate fit so that it is an interference fit between the locking surfaces 62, 64. The locking member 66 may be pressed into the gap between the locking surfaces 62, 64 with a predetermined pressure or force.

An end position can be defined for the interlocking member 66 in which the two metal parts 20, 40 are firmly locked together and the interlocking member 66 can only be moved with force due to friction on the locking surfaces 62, 64. In this state, the interlocking member 66 may protrude beyond the surface of the metal parts 40, 60, flush with at least one of them, or form a recess in the cable connector 1.

The first metal part 20 is moved by the locking member 60 in a first locking direction 50, and the second metal part 40 is moved in a second locking direction 52. The locking directions 50, 52 are different from each other, in particular opposite to each other (scalar product <0) and can in particular be antiparallel to each other.

Figure 2:
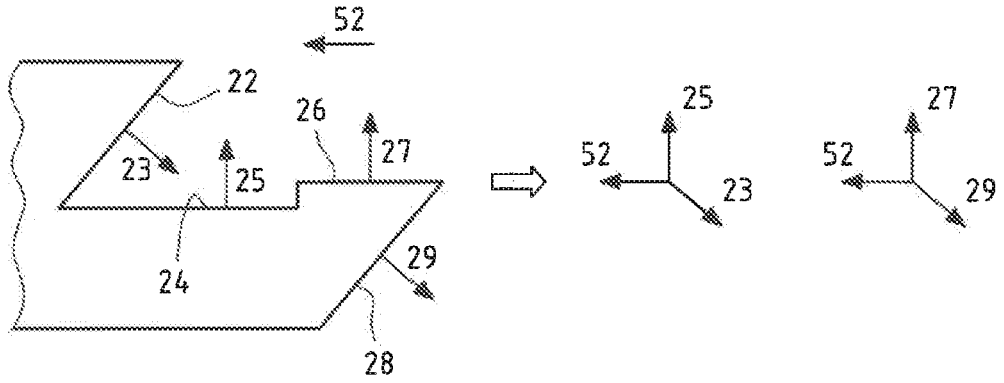
FIG. 2 Embodiments of an object metal part with drawn surface normals.

With reference to FIG. 2, it should be noted that the evaluation of whether two vectors are perpendicular to each other can be performed in such a way that the vectors are shifted so that their starting points are identical (see right part of FIG. 2). For the case shown in FIG. 2, it is obvious that the surface normal vectors 23, 29 of the abutting surfaces 22 and 28 of the first connecting part 20 are opposite to both the locking direction 52 of the second metal part 40 and the surface normal vectors 25, 27 of the contact surfaces 24 and 26.

In one aspect, this causes the first metal part 20 to hold up the second metal part 40 in the locking direction, since the abutting surfaces 42 and 48 of the second metal part 40 abut against the abutting surfaces 22, 28 of the first metal part 20, which abut against the locking direction 52 of the second metal part 40. This applies in exactly the opposite manner to the first metal part 20, which is prevented from further movement in its locking direction 50 by the abutting surfaces 42, 48 of the second metal part 40.

In addition, the orientation of the abutment surface normals 23, 29 in opposition to the associated contact surface normals 25, 27 causes the second metal part 40, which is moved by the interlocking member 60 against the abutment surfaces 22, 28, to be diverted in the direction of the contact surfaces 24, 26. The second metal part 40 now abuts against these contact surfaces 24, 26 with its respective contact surfaces 46, 44, so that it is held at least in a force-locking and form-locking manner.

FIG. 3 shows various possible orientations of the contact surfaces 24, 46, 26, 44 and abutting surfaces 28, 42, 22, 48 of the two metal parts 20, 40. A top view of the cable connector 1 in question is shown. The contact and abutting surfaces 24, 46, 26, 44 may here be substantially planar surfaces with a single orientation perpendicular to the drawing plane. They may also each be curved, twisted or otherwise deformed. At least one segment of each surface is intended to be oriented substantially perpendicular to the drawing plane for the following considerations, so that the seam lines of FIG. 3 reveal the area-by-area orientation of the surfaces. In the embodiments shown in FIGS. 3 *a-c*, the interlocking directions 50, 52 of the two metal parts 20, 40 are parallel to the contact surfaces 24, 26, 44, 46, which are aligned parallel to each other in the joined state.

For a more detailed explanation of the surface orientations, please refer to FIG. 3, in which the surface normals 23

(perpendicular to rear abutment surface 22), 25 (perpendicular to rear contact surface 24), 27 (perpendicular to front contact surface 26), 29 (perpendicular to front abutment surface 28) for the first metal part 20 are shown.

It can be seen that in all embodiment examples of FIGS. 3 *a-c*, the abutting surfaces 22, 28, 42, 48 are oppositely directed to the locking direction of the respective other metal part (scalar product between surface normal vectors 23, 25, 27, 29 and locking direction vector 50, 52 <0).

It can also be seen that the surface normal vectors 23, 29 of the abutting surfaces 22, 28 are oppositely directed to their respective associated contact surface.

FIG. 3 *d* shows a design in which the contact surfaces 24, 26, 44, 46 are curved in plan view. They can also be curved to such an extent that their area-wise surface normals no longer oppose the surface normals of the associated abutting surfaces 22, 28, 42, 48. It is sufficient if the surface normals of the contact surfaces 24, 26, 44, 46 are regionally opposed to the surface normals of the respective associated abutting surfaces 22, 28, 42, 48.

In the embodiments of FIGS. 3 *a-d*, the abutting surfaces 22, 28, 42, 48 are for the most part located further away from the interlocking member 60 than the respective associated contact surfaces 24, 26, 44, 46 throughout. However, the abutting surfaces 22, 28, 42, 48 can also be located closer to the interlocking member 60 than at least regions of the associated contact surfaces 24, 26, 44, 46, as shown in FIG. 3 *e*.

Contact and abutting surfaces 24, 26, 44, 46, 22, 28, 42, 48 generally need not be formed from a single planar segment but may include segments of different orientations. An exemplary embodiment with such surfaces is shown in FIG. 3 *f*. Here, the abutting surfaces 22, 48, 26 and 42 have first been separated into sub-regions (22*a*, 22*b*, 22*c*, as well as 48*a*, 48*b*, 48*c* and 28*a*, 28*b*, 42*a*, 42*b*), each of which has an orientation according to the invention. The horizontal abutting surface regions in the figure have a different orientation. Overall, the abutting surfaces comprise these horizontal sub-regions and the sub-regions aligned according to the invention (22*a*, 22*b*, 22*c*, as well as 48*a*, 48*b*, 48*c* and 28*a*, 28*b*, 42*a*, 42*b*). The abutting surface 28 has been provided with highlights. The protrusions 28*a*, 28*b* themselves can also be considered as the abutting surface 28. Their surface orientation is irrelevant to the function of the invention. However, at least small segments of the protrusion will be oriented opposite to both the locking direction 52 of the second metal member 40 and the surface normal of the associated contact surface 26. The orientation of the abutting surface 42, more specifically its partial regions 42*a*, 42*b*, already causes the first metal part 20 with its contact surface 26 to be pressed against the contact surface 44 of the second metal part 40. Here, it is clear that the area-wise opposite alignment of the two contacting abutting surfaces (22, 48) and (28, 42) is sufficient to press the associated contact surfaces (24, 46) and (26, 44) against each other by means of the interlocking member 60.

FIG. 3 *g* shows another related embodiment in which the abutting surfaces 22, 48 and 28, 42 are divided into three sub-regions, each having a substantially constant orientation. The horizontally aligned sub-regions (surface normals substantially vertical) are here aligned in accordance with the invention. The vertically aligned partial areas (surface normals essentially horizontal) alone would not achieve the desired interlock. Here, too, the term "abutting surface" can refer only to the horizontally aligned subarea in each case, or to the composite surface consisting of two vertical and one horizontally aligned subarea in each case.

Figure 4A:
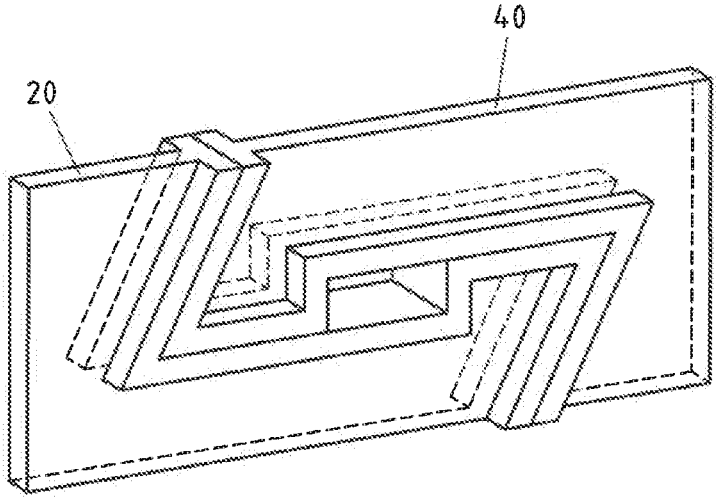
FIG. 4*a-b* An embodiment of the present cable connector in isometric view.

FIG. 4 shows two different exemplary designs of the metal parts 20, 40. In FIG. 4*a*, both metal parts 20, 40 are formed from several flat segments. The contact surfaces 24,26, 44, 46 and abutting surfaces 22, 28, 42, 48 are formed by respective flat segments directed substantially parallel to the respective contact or abutting surface. Perpendicular flat elements are provided for this purpose to increase mechanical stability. These are optional. One advantage of this design is the reduced material requirements, and another is the increased surface area to the environment over which heat can be radiated and dissipated elsewhere, such as by convection.

Figure 4B:
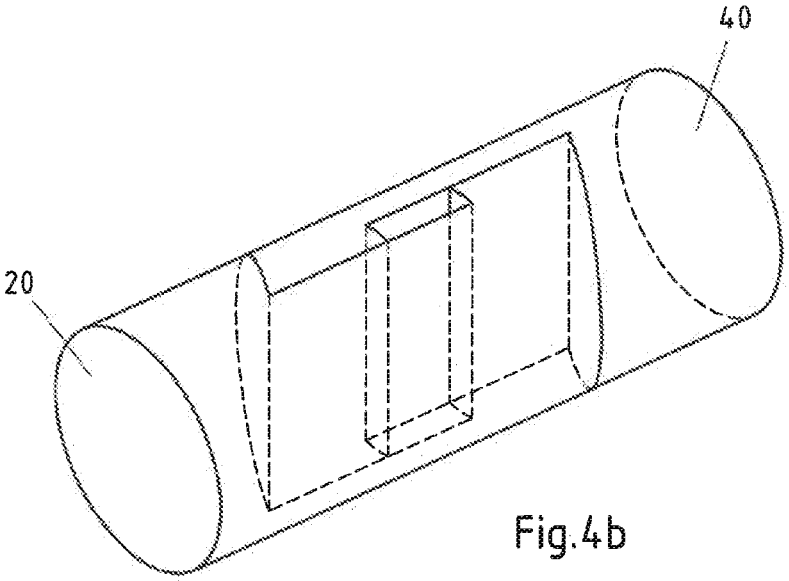

Another design, shown in FIG. 4*b*, resembles a cylinder. A cylindrical shape facilitates integration of the cable connector 1 into cable harnesses. This is because, for example, the connector can be brought approximately to cable diameters, particularly for cables with round diameters. In this way, thickening along the cable harness in the area of the cable connector 1 is avoided. Also, thanks to a lack of edges, injury to adjacent components, in particular cables, becomes less likely.

Figure 3A:
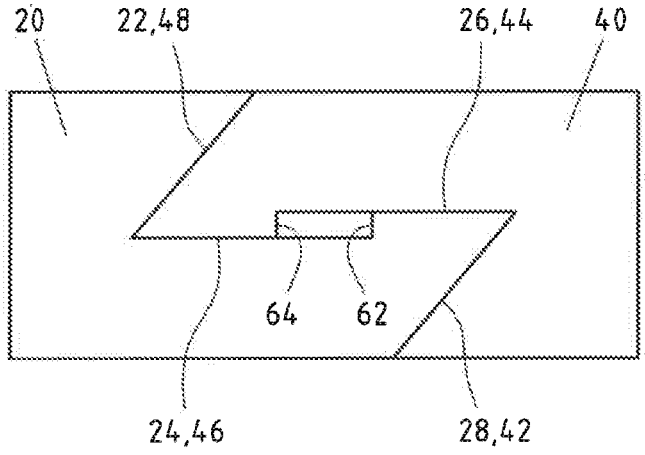
FIG. 3*a-g* An embodiment of two representational metal parts hooked into each other in plan view.
Figure 3B:
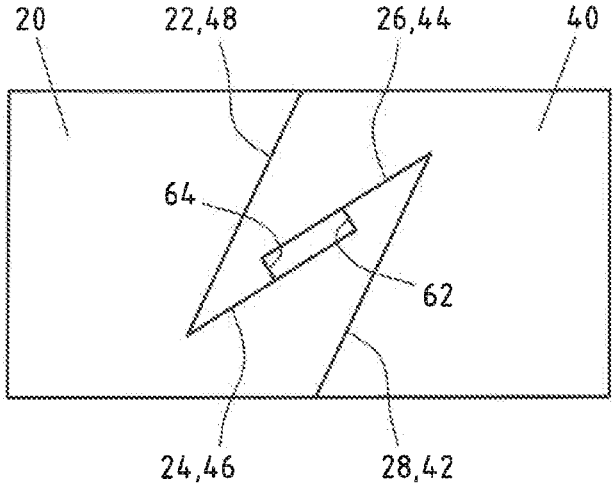
Figure 3C:
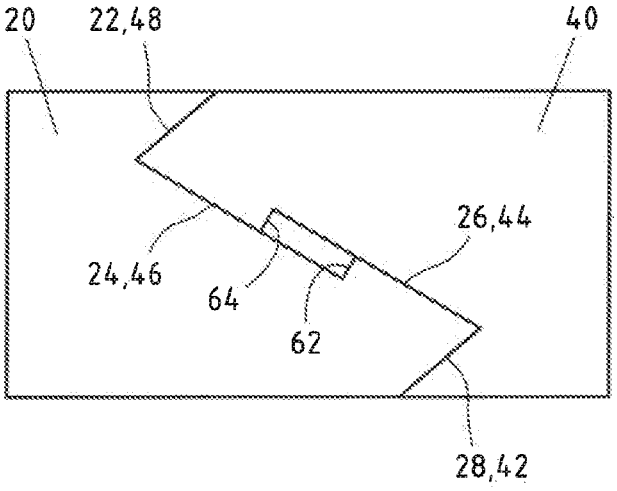
Figure 3D:
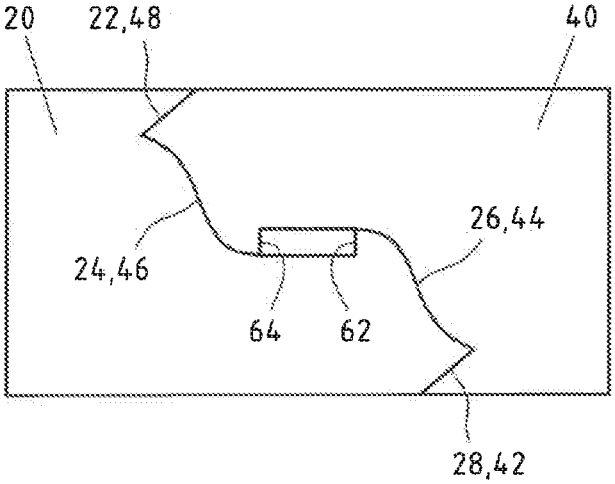
Figure 3E:
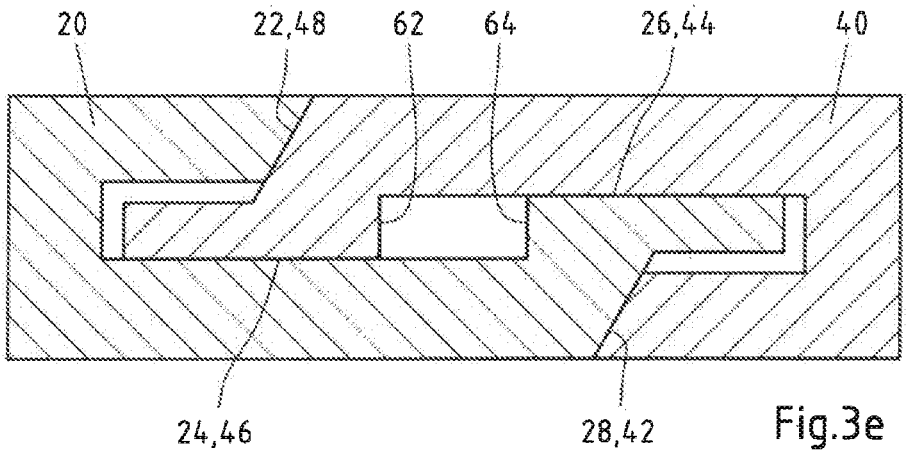
Figure 3F:
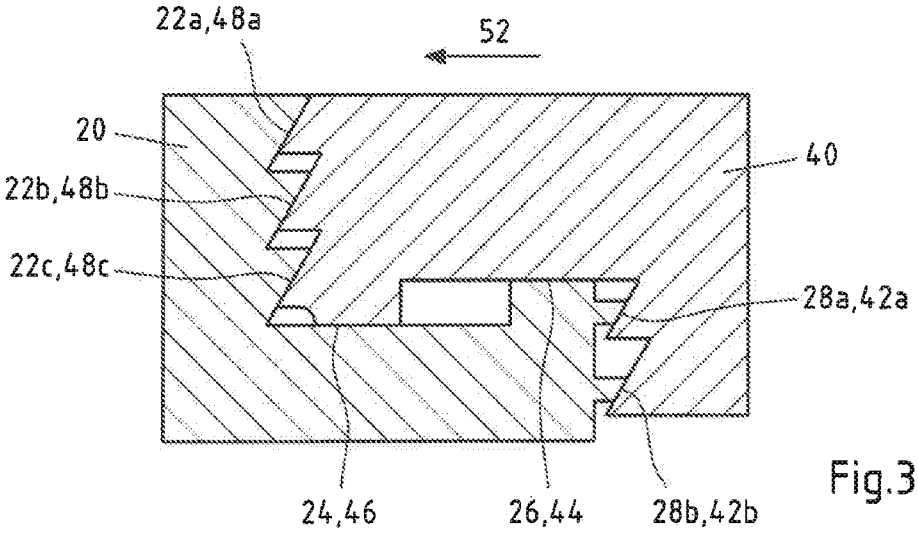
Figure 3G:
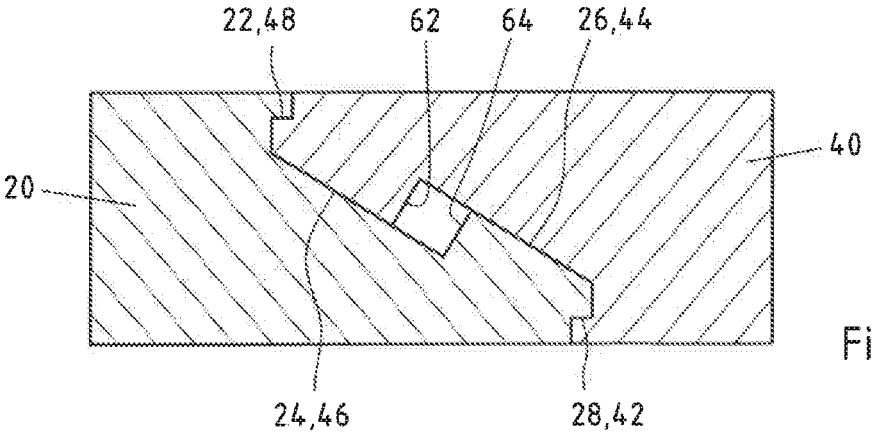
Figure 5A:
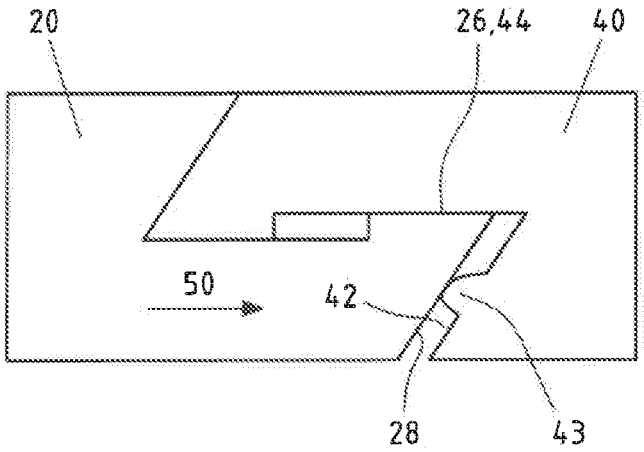
FIG. 5*a-c* Embodiments of the abutting surfaces of the present cable connector.
Figure 5B:
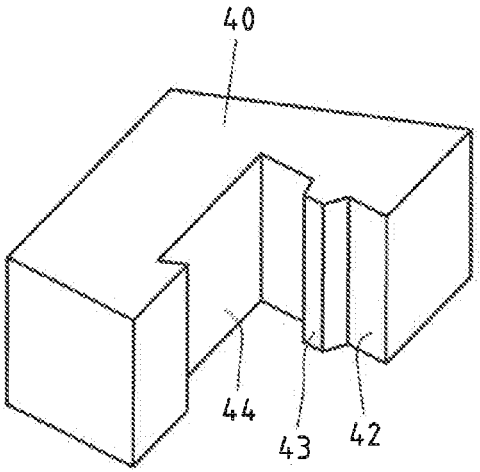
Figure 5C:
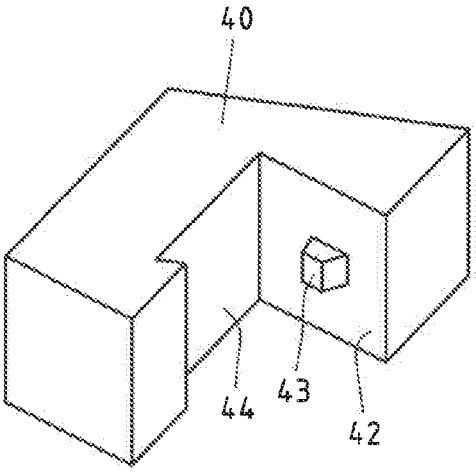

FIG. 5 further elaborates the embodiment example of FIG. 3*g*. One of the abutting surfaces of two abutting surfaces in contact with each other may be shaped as one or more punctiform, linear or otherwise shaped elevations instead of a surface. The protrusion may be flattened and have an end face oriented substantially parallel to the surface abutting it when locked. However, it may also be rounded. A rounded shape is shown in FIG. 5*a*. If the elevation has a rounded shape, only a very small surface segment of the abutting surface 42 is aligned against the locking direction 50 of the first metal part 20 and the surface normal of the contact surface 44. The orientation of the other respective abutting surface, which is formed as a surface, is sufficient to guide the two contact surfaces associated with the respective abutting surfaces towards each other starting from the force emanating from the interlocking member 60. The elevations of the one abutting surface may, for example, substantially describe a line as in FIG. 5*b*. Here, the elevation is not rounded as in FIG. 5*a*, but has a flattened end face. However, a rounded shape is just as possible. Several such mutually parallel or mutually inclined linear elevations are also possible. Alternatively, punctiform elevations as in FIG. 5*c* are conceivable. Here, too, single or multiple elevations distributed in an ordered or disordered manner on the abutting surface are conceivable. Also, at least one abutting surface can alternatively be strongly roughened, so that an irregularly shaped surface structure with elevations and depressions results, which partially contact and/or are pressed into the opposite abutting surface of the respective other metal part in certain areas and/or penetrate into the opposite abutting surface when the present cable connector 1 is locked.

FIG. 6 shows possible embodiments of interlocking members 60, in addition to the wedge 66 disclosed in FIG. 1*a*, with locking surfaces 62, 64.

In particular, some guided embodiments of locking members 66 are disclosed. The guide 67 may have the characteristic that the locking member 66 can only move along one direction. Further, the guide 67 may connect the locking member 66 to at least one of the metal members 20, 40 in a manner that prevents loss. This has the advantage that for the assembly of the present cable connector 1 only two separate elements need to be handled, namely the two metal parts 20, 40. No interlocking member 66 needs to be kept in stock in a processing machine, etc. Also, when the cable connector 1 is opened, the locking member 66 is not in danger of being lost.

Figure 6A:
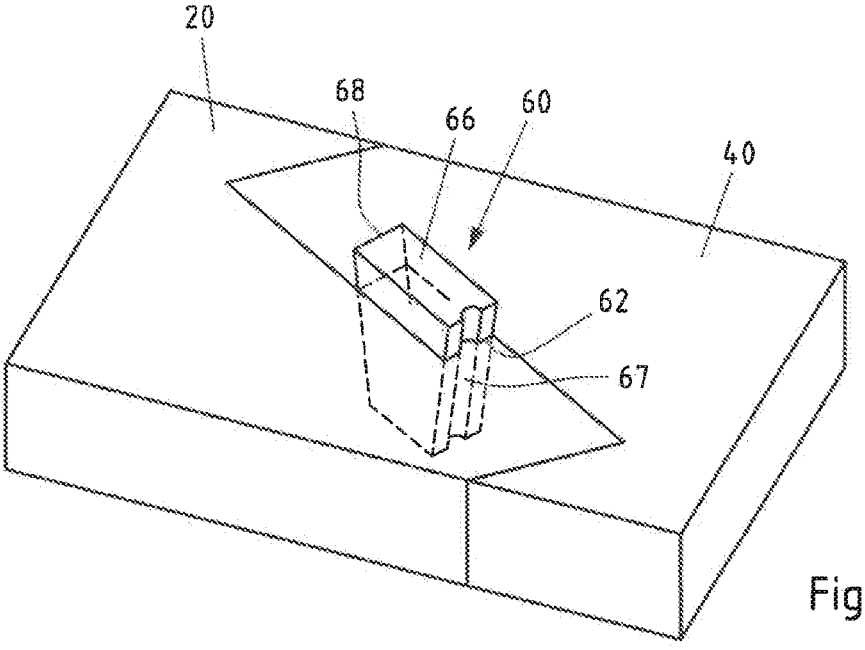
FIG. 6*a-f* Embodiments of the interlocking member of the present cable connector.

In FIG. 6*a*, a wedge is disclosed as a interlocking member 66 which is movable along a guide 67. This guide 67 may comprise a rail or otherwise substantially linear protrusion in the locking surface 62, which is encompassed by a groove or otherwise substantially linear recess in the locking member 66. Also, the guide may be arranged as a recess in the locking surface 62 of metal part 20 (or the locking surface 64 of metal part 40) and the elevation may be arranged on the interlocking member 66.

Figure 6B:
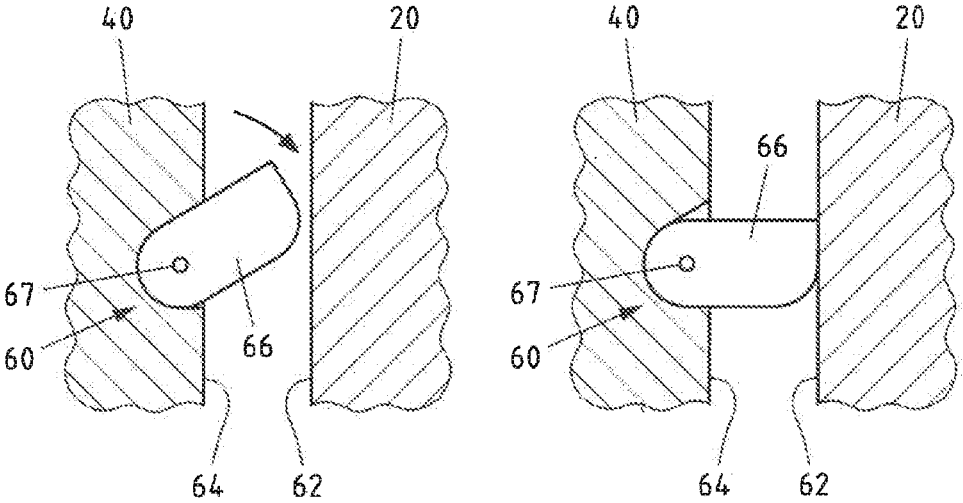

Another example of a interlocking member 60 with guide 67 is shown in FIG. 6*b*. Here, the locking member 66 can be rotated around a guide 67 formed as a rotational bearing. By turning the locking member 66 from the upper position to the lower position shown in FIG. 6*b*, locking of the cable connector 1 is achieved. A shown rounding of the interlocking member 66 is advantageous here in order to be able to move the interlocking member 66 in the gap entirely into the final position shown in the lower part of FIG. 6*b*.

Figure 6C:
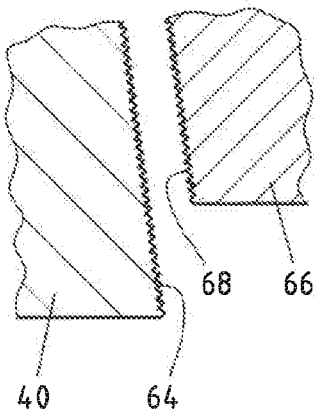
Figure 6D:
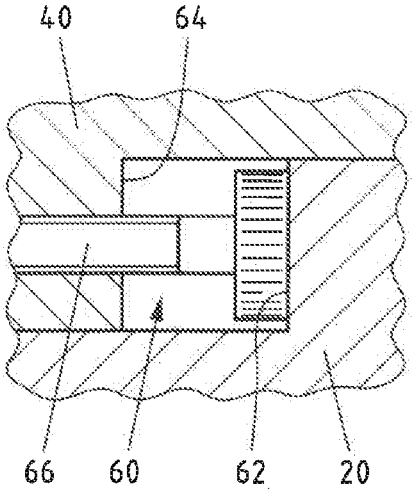

In both shown, but also in other interlocking member configurations, it can be helpful to increase the friction between interlocking member 66 and locking surfaces 62, 64. This can be done by roughening the surface, by sandblasting, etching, and other processes, or also by means of deliberate relief, for example in casting, by means of which grooves, nubs, waves, etc. are produced, which can increase the friction between interlocking member 66 and locking surfaces 62, 64. FIG. 6*c* shows roughened surfaces as an example.

Alternative locking members 60 are shown in FIGS. 6 *d-f*. In FIG. 6*d*, the interlocking member 60 comprises a screw guided in a thread of a first metal part 20, which can be rotated against the locking surface 64 of the second metal part 40. In this case, the locking member 66 is the screw.

Figure 6E:
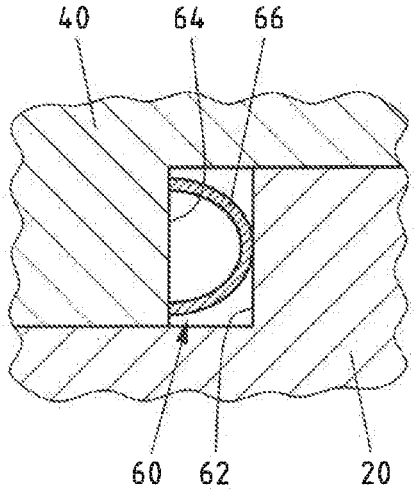
Figure 6F:
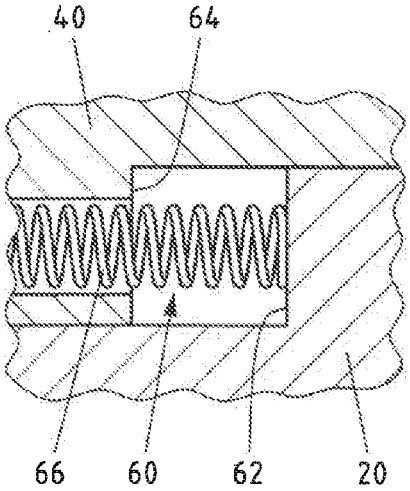

FIG. 6*e* shows a spring element as a interlocking member 66, which is fixedly or movably attached to the locking surface 62 of the first metal part 20 and is pressed in when the two metal parts 20, 40 are put together so that the restoring force of the spring element moves the two metal parts 20, 40 apart. Analogous to FIG. 6*e*, FIG. 6*f* shows a different spring element. The spring element of FIG. 6*d* has the advantage that lateral insertion does not significantly deflect the spring downward and that the spring can press the metal part in the locking direction even after insertion. The spring of FIG. 6*f* may require a further guide in the spring direction. Spring element as interlocking member 66 generally have the advantage that the two metal parts 20,40 can be pushed together and are immediately locked. The disadvantage, however, is a significantly reduced force exerted by the interlocking member 60 compared to, for example, a metal wedge press-fitted under pressure. Thus, the normal force on impact and contact surfaces is reduced and the contact may become more highly resistive.

Figure 7A:
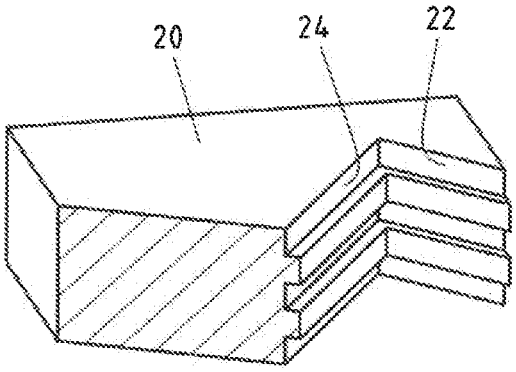
FIG. 7*a-e* Embodiments of the contours of abutting and contact surfaces of the present cable connector.

As previously discussed, contact surfaces 24, 26, 44, 46 and abutting surfaces 22, 28, 42, 48, and also locking surfaces 62, 64 need not be planar with a single orientation but may have areas of different orientations. Some examples of such surface shapes are shown in FIG. 7. Here a relief is shown as would be visualized by cutting through the two metal parts 20, 40. It is advantageous if the surfaces of the metal parts 20, 40 can slide along each other in a preferred direction. This can be ensured for the contact surfaces by the profile being constant along a direction perpendicular to the locking direction of the metal part along the locking direction of at least one of the metal parts. For example, grooves may be formed in the metal along this direction. For the abutting surfaces 22, 28, 42, 48, a constant relief in the direction towards the associated contact surface is to be helpful so that the metal part slides along this profile towards the contact surface. FIG. 7*a* shows a described advantageous profile course with an exemplary angular profile.

In addition, it is helpful if the metal parts 20, 40 interlock at the contact and abutting surfaces. In this way, the metal parts 20, 40 are, on the one hand, securely guided. In addition, they hold together better in the locked state and, moreover, the contact area is increased in comparison with flat contact and abutment surfaces. The profiling described is particularly advantageous for the contact surfaces.

Figure 7B:
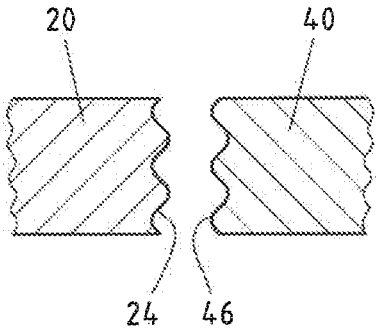
Figure 7C:
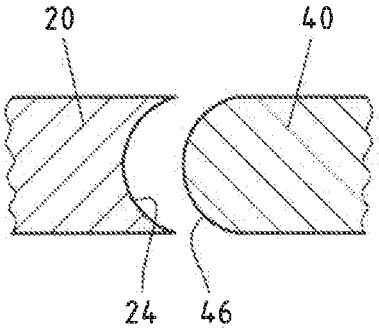
Figure 7D:
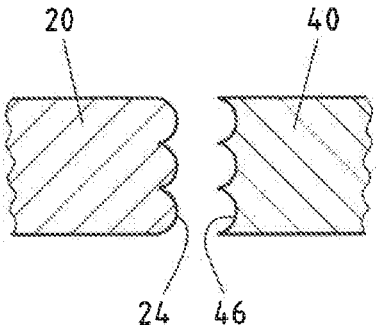
Figure 7E:
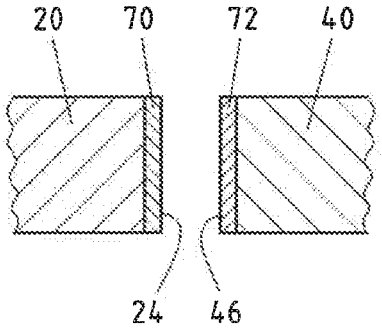

FIG. 7*b* shows a first wave-shaped profile, while FIG. 7*c* shows a concave profile of a first surface and a complementary convex profile of a second surface. FIG. 7*d* shows another embodiment of interlocking surfaces.

To improve the contact between the abutting contact and abutting surfaces, they can be coated, in particular by softer metals such as nickel or tin. Other metals such as gold are also conceivable, or other conductive materials. A coating is advantageously arranged only in the region of the contacting contact and abutting surfaces, see coatings 70,72 in FIG. 6*e*.

The cable connector 1 described so far generally still has an unprotected metal outer surface. This has the disadvantage that it can come into electrical and mechanical contact with other conductors, and there is also a risk of corrosion or other damage due to environmental influences. To eliminate these risks, it is advantageous to insulate the present cable connector 1 from the outside. This can be done by a housing which is placed around the cable connector 1 after connection and locking.

Figure 8A:
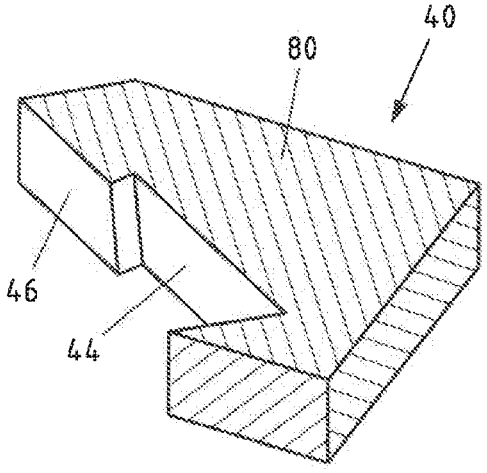
FIG. 8*a-d* Embodiments of an insulated subject cable connector.
Figure 8B:
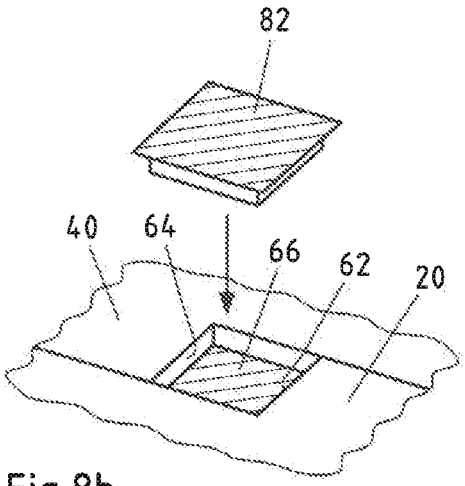
Figure 8C:
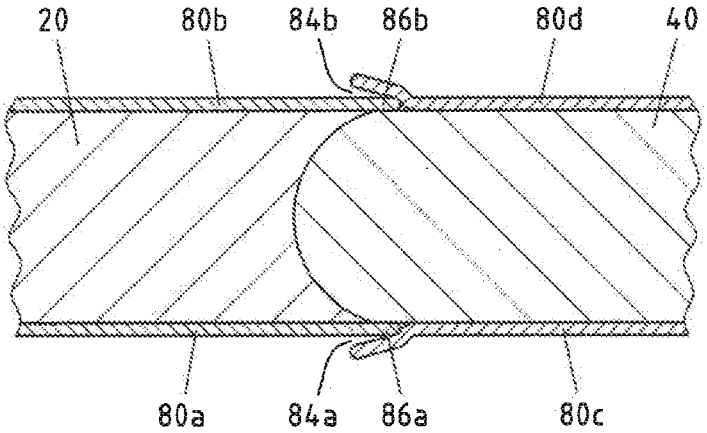

FIG. 8*a* shows another advantageous embodiment of insulation from the surroundings. Here, the metal parts 20, 40 are coated with an insulation layer 80 on at least parts of the outer surfaces which are not contact surfaces, abutting surfaces, interlocking surfaces or other outer surfaces which are not to be insulated. This is preferably a non-conductor and can be made of plastic, silicone, rubber, but also ceramic, glass, etc.

To enable complete insulation of the metal parts 20, 40 of the cable connector 1 in the locked state, a cover 82 may close the opening in the region of the interlocking member 60 after locking. The cover 82 may also be part of the interlocking member 66, which may have, for example, an insulating closure which blocks the opening when pushed in. Also, the lid may be formed as part of the housing. It is also possible for the head of the wedge to have an insulating coating. Also, the wedge may be formed as part of the housing.

In the area of the transitions between insulation layer 80 and contact and/or abutting surfaces, which must be in direct electrical and mechanical contact with each other, there is an increased risk of moisture penetration. To avoid this, the insulation layer 80 can project over the surfaces as shown in FIG. 8 *c, d*. A groove 84 in the protrusion of the insulation layer 80 on one metal part and a corresponding protrusion 86 engaging the groove on the insulation layer 80 of the other metal part can allow increased insulation performance in the junction of the two metal parts 20, 40. Also, a plurality of grooves 84 and lips 86 may be provided, arranged side by side, each engaging the other to increase the sealing effect.

Figure 8D:
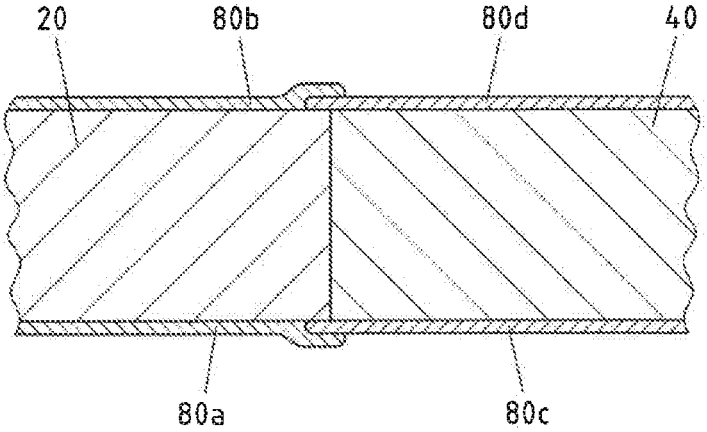

Also, as shown in FIG. 8*d*, an insulation layer 80 *a,b* of a first metal part 20 can be softer than the insulation layer 80 *c,d* of the second metal part 40. As a result of the fact that the protrusion of the harder insulation layer 80 *c,d* can be pressed into the softer insulation layer 80 *a,b*, the insulation becomes particularly tight.

Figure 9A:
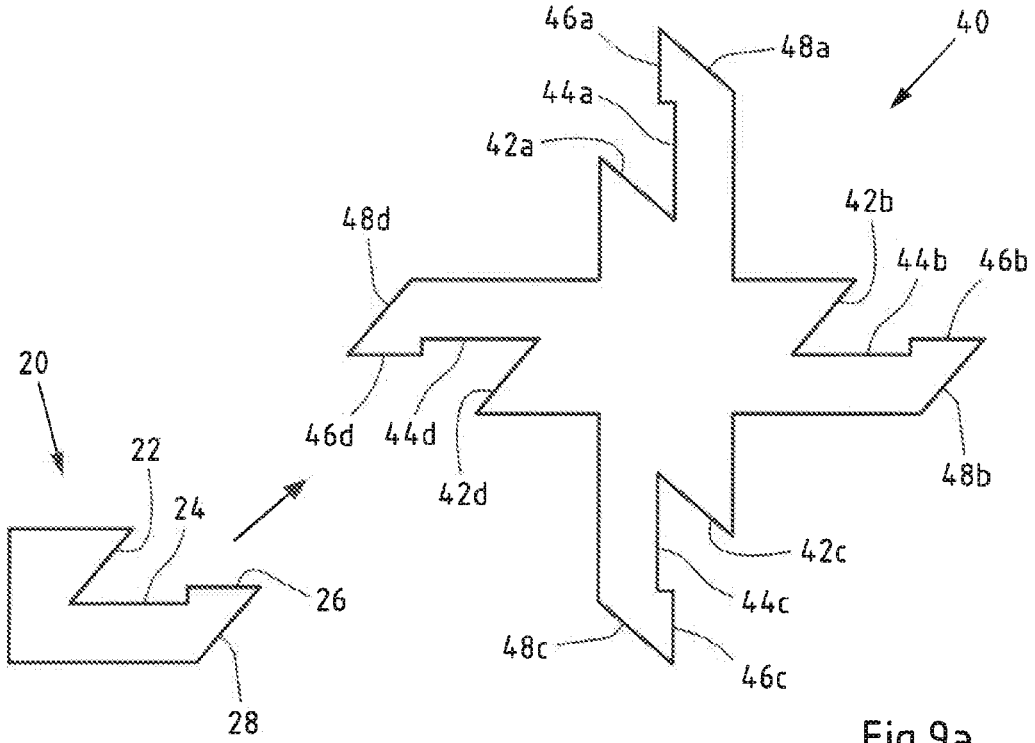
FIG. 9*a-b* Embodiments of a cable connector with a metal part provided for multiple contacts.
Figure 9B:
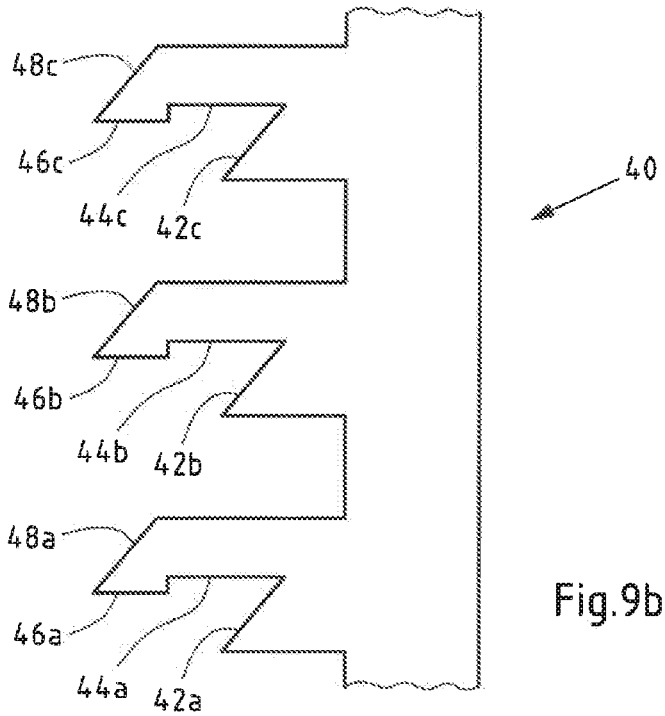

The present cable connectors 1 described so far are intended for connecting two cables or other components. It is also possible to extend the connection concept to several cables. In FIG. 9, an exemplary cable connector 1 is shown in which the second metal member 40 includes a plurality of docking portions for cable connectors 1, each comprising a front abutment surface 48, front contact surface 46, rear contact surface 44, and rear abutment surface 42. Also provided are at least portions of locking members 60. FIG. 9*a* demonstrates a star-shaped design, and FIG. 9*b* demonstrates a side-by-side design.

Figure 10A:
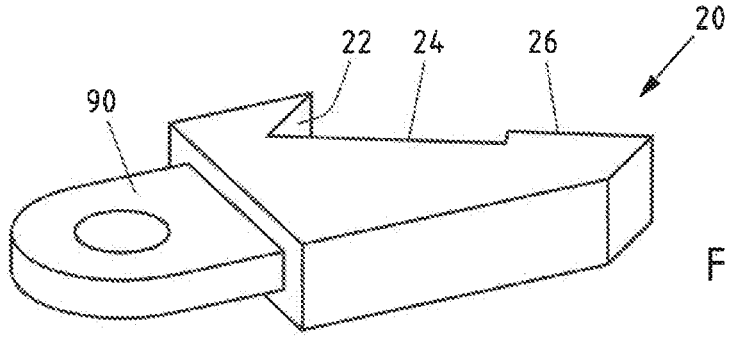
FIG. 10*a-d* Embodiments of connection terminals of the subject cable connector.
Figure 10B:
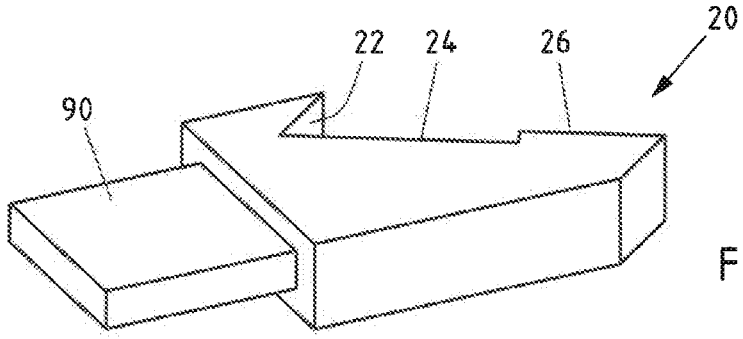
Figure 10C:
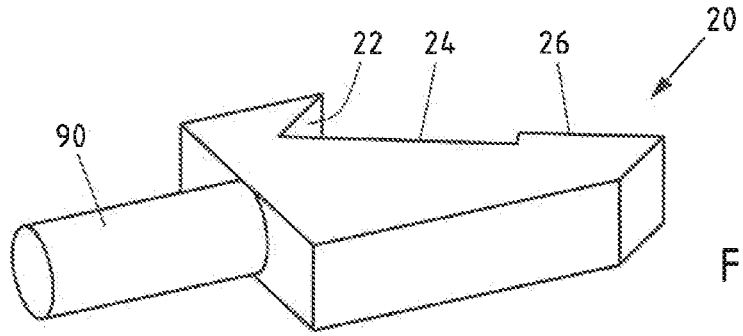
Figure 10D:
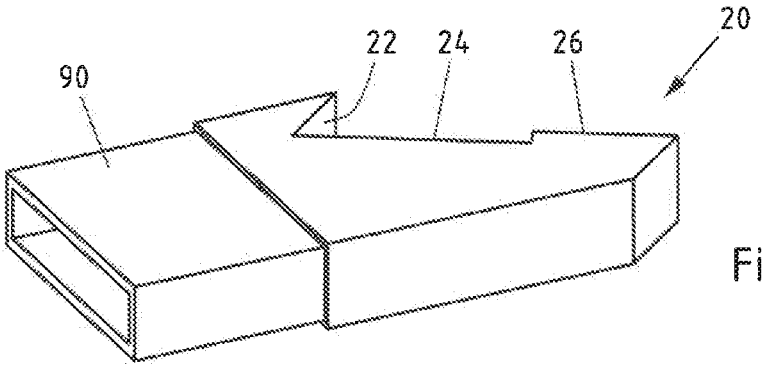

Connections are needed to connect the cable connector 1 to cables. For example, FIG. 10 shows some embodiments of cable connection terminals 90. In FIG. 10*a*, a tab with a hole is disclosed for this purpose. This can be used for screw or riveted connections. FIG. 10*b* shows a flat terminal 90 without a hole, for example for press or solder connections. FIG. 10*c* shows a round terminal 90, which can be formed as a solid material. Here, for example, cables can be welded on, in particular by means of friction welding, ultrasonic welding, and/or laser welding. Also conceivable is a hollow design as a sleeve 90 as shown in FIG. 10*d*, which can accommodate cables or other elements, for example as a cable lug. The sleeve 90 can also have a round cross-section.

What is claimed is:

1. Cable connector for motor vehicles comprising:

a first metal part;

a second metal part abutting the first metal part;

an interlocking member moving the two metal parts apart in a respective locking direction, wherein the interlocking member has a first locking surface at the first metal part and a second locking surface at the second metal part, which face in opposite directions and are spaced apart and, wherein the interlocking member further has a locking part, which is situated between the two locking surfaces and moves them apart;

wherein each of the two metal parts has a respective front abutment surface and associated front contact surface remote from the interlocking member in the locking direction of the respective metal part and a respective rear abutment surface and associated rear contact surface remote from the interlocking member opposite to the locking direction of the respective metal part, wherein, in a locked state of the cable connector, the front abutment surface of each of the two metal parts abuts the rear abutment surface of the respective other metal part, and the front contact surface of each of the two metal parts abuts the rear contact surface of the respective other metal part, wherein the surface normals of the front and rear abutment surfaces of a respective one of the metal parts run at least in regions opposite to the locking direction of the respective other metal part, and for each of the two metal parts, the surface normals of the front abutment surfaces run at least in regions opposite to the surface normal of at least part of the associated front contact surfaces, and for each of the two metal parts, the surface normals of the rear abutting surfaces run at least in regions opposite to the surface normal of at least a part of the associated rear contact surfaces.

2. Cable connector for motor vehicles according to claim 1, wherein the front contact surface of at least one of the two metal parts is substantially in direct contact with the rear contact surface of the respective other metal part over the width perpendicular to the locking direction, at least in regions, and the surface profiles of the two contact surfaces are substantially constant along the locking direction of at least one of the two metal parts.

3. Cable connector for motor vehicles according to claim 1, wherein the interlocking member comprises a first locking surface on the first metal part and a second locking surface on the second metal part, which are opposed to each other and which are spaced apart by a gap, and a locking wedge abuts both locking surfaces, so that the locking wedge pushes the two metal parts apart in their respective locking direction.

4. Cable connector for motor vehicles according to claim 1, wherein the two metal parts are shaped substantially identically to each other.

5. Cable connector for motor vehicles according to claim 1, wherein the area-wise surface normals of front and rear abutting surfaces and front and rear contact surfaces of both metal parts and the locking directions of both metal parts are substantially parallel to a common plane.

6. Cable connector for motor vehicles according to claim 1, wherein the surface normals of the front and/or rear contact surfaces of at least one of the two metal parts are directed substantially in the same direction, at least in regions.

7. Cable connector for motor vehicles according to claim 1, wherein the surface normals of the front and rear contact surfaces of at least one of the two metal parts are directed substantially in the same direction, at least in some areas.

8. Cable connector for motor vehicles according to claim 1, wherein the locking direction of the first metal part is substantially opposite to the locking direction of the second metal part, in particular that the locking directions of the two metal parts are antiparallel to each other.

9. Cable connector for motor vehicles according to claim 1, wherein the front abutment surface of at least one of the two metal parts is at least partially concave in shape and/or the rear abutment surface of the respective other metal part is at least partially convex in shape, or the front abutment surface of at least one of the two metal parts is at least partially convex in shape and/or the rear abutment surface of the respective other metal part is at least partially concave in shape.

10. Cable connector for motor vehicles according to claim 1, wherein the front abutment surface of one of the two metal parts has local, in particular punctiform or linear, elevations.

11. Cable connector for motor vehicles according to claim 1, wherein the front contact surface of at least a first one of the two metal parts is at least partially concave-shaped and the rear contact surface of the respective other metal part is at least partially convex-shaped, or in that the front contact surface of at least a first one of the two metal parts is at least partially convex-shaped and the rear contact surface of the respective other metal part is at least partially concave-shaped.

12. Cable connector for motor vehicles according to claim 1, wherein at least one of the contact surfaces or abutting surfaces of at least one metal part has an electrically conductive coating, in particular a nickel, silver, gold or copper coating.

13. Cable connector for motor vehicles according to claim 1, wherein at least one abutment surface of at least one metal part abuts indirectly against the abutment surface of the other metal part and a conductor or a non-conductor is arranged between the abutment surfaces and/or at least one contact surface of at least one metal part abuts indirectly against a contact surface of the other metal part and a conductor is arranged between the contact surfaces.

14. Cable connector for motor vehicles according to claim 1, wherein at least one of the two metal parts is sheathed with an insulating layer, in particular with a non-conductor, on at least one surface that is not a contact or abutting surface.

15. Cable connector for motor vehicles according to claim 1, wherein the insulating layer of at least one of the two metal parts projects beyond at least one contact and/or abutting surface and/or in that the insulating layer of the first metal part engages in the insulating layer of the second metal part in the joined state, in particular in that the insulating layers of the two metal parts engage in one another in a watertight manner at least in sections or circumferentially.

16. Cable connector for motor vehicles according to claim 1, further comprising a cover that covers the interlocking member in the locked state, in particular in that the cover is a contact protection for the cable connector and/or makes it watertight to the outside.

17. Cable connector for motor vehicles according to claim 1, wherein the interlocking member is a screw element, a clamping element, a spring element, and/or a wedge.

18. Cable connector for motor vehicles according to claim 1, wherein at least one of the metal parts has a connection bracket, in particular a hole, a connection tab, a plug, a plug socket, a thread, a clamp, and/or a welding surface.

19. Cable connector for motor vehicles according to claim 1, wherein the first metal part is made of a first metal material and the second metal part is made of a second metal material, wherein the first metal material is different from the second metal material or the first metal material matches the second metal material.

20. Cable connector for motor vehicles according to claim 1, wherein at least one of the metal parts is at least partially formed as a flat part and/or at least one of the metal parts is at least partially formed as a solid material.

21. Cable connector for motor vehicles according to claim 1, wherein the two metal parts substantially complement each other in the locked state to form a cuboid, a cylinder, a sphere, an ellipsoid or a wedge.

22. Cable connector for motor vehicles according to claim 1, wherein at least the first metal part has at least two further contact surfaces and two further abutting surfaces in which a further metal part can engage, and an at least second interlocking member locks the first metal part to the second metal part.

* * * * *